US007216517B2

(12) United States Patent
Ling et al.

(10) Patent No.: US 7,216,517 B2
(45) Date of Patent: May 15, 2007

(54) PADLOCK WITH A STATUS INDICATOR

(75) Inventors: Renny Tse-Haw Ling, Taipei Hsien (TW); Yung-Li Kuo, Taipei Hsien (TW)

(73) Assignee: Sinox Co., Ltd., Taipei Hsien (TW)

( * ) Notice: Subject to any disclaimer, the term of this patent is extended or adjusted under 35 U.S.C. 154(b) by 0 days.

(21) Appl. No.: 11/134,307

(22) Filed: May 23, 2005

(65) Prior Publication Data

US 2005/0262903 A1 Dec. 1, 2005

(30) Foreign Application Priority Data

May 27, 2004 (TW) ..... 93115071 A

(51) Int. Cl.
*E05B 37/02* (2006.01)

(52) U.S. Cl. ..... 70/21; 70/28; 70/29; 70/44; 70/47; 70/284; 70/285; 70/432

(58) Field of Classification Search ..... 70/21, 70/22, 25, 27–29, 41–47, 284, 285, 432–441, 70/DIG. 63, DIG. 71
See application file for complete search history.

(56) References Cited

U.S. PATENT DOCUMENTS 232,070 A * 9/1880 Russell ..... 70/437
1,757,020 A * 5/1930 Ramey ..... 70/437
4,014,191 A * 3/1977 Harrington et al. ..... 70/25
5,664,446 A * 9/1997 Kusmiss ..... 70/330
6,029,481 A * 2/2000 Lai ..... 70/25
6,478,437 B2 * 11/2002 Roach ..... 362/23
6,877,345 B1 * 4/2005 Misner et al. ..... 70/25
6,928,842 B1 * 8/2005 Huang ..... 70/21
7,007,521 B1 * 3/2006 Misner et al. ..... 70/21
7,047,772 B2 * 5/2006 Yu ..... 70/21
7,047,773 B1 * 5/2006 Lin ..... 70/25
2002/0088256 A1 * 7/2002 Taylor et al. ..... 70/25
2005/0044901 A1 * 3/2005 Yu ..... 70/25
2005/0235706 A1 * 10/2005 Ling et al. ..... 70/29
2005/0262902 A1 * 12/2005 Ling et al. ..... 70/21
2006/0032274 A1 * 2/2006 Yu ..... 70/25
2006/0107708 A1 * 5/2006 Yu ..... 70/21
2006/0107709 A1 * 5/2006 Yu ..... 70/21
2006/0107710 A1 * 5/2006 Yu ..... 70/25

* cited by examiner

*Primary Examiner*—Lloyd A. Gall
(74) *Attorney, Agent, or Firm*—Birch, Stewart, Kolasch & Birch, LLP

(57) ABSTRACT

A padlock with a status indicator includes two locking units. The two locking units operate independently to execute locking and unlocking operations. The lock has a body that contains an indicator in the lock underneath. After the execution of the unlocking operation has been done sequentially, the indicator switches from an indication position to the other indication position. Thus through the window, which is formed on the body surface and corresponding to the indicator location, the indication positions of the indicator may be recognized.

16 Claims, 3 Drawing Sheets

PADLOCK WITH A STATUS INDICATOR

FIELD OF THE INVENTION

The invention relates to a padlock with a status indicator adopted for use on padlocks, locking devices or structural objects and particularly to a lock that combines two locking units that function independently to execute locking and unlocking operations.

BACKGROUND OF THE INVENTION

Locks are widely used to guard articles that have obvious or potential security concerns. For instance, a padlock may be used to lock the zipper of a piece of luggage to prevent unauthorized opening.

Due to security reasons, nowadays airports have very strict standards for luggage security inspection. With luggage that may be a security risk, mandatory opening of the luggage for security inspection could take place. For the luggage that has been locked, the lock has to be broken. After security inspection, the lock is damaged and becomes unusable. As a result, the damaged lock can no longer provide protection after the security inspection has been completed.

To remedy the problem of lock damage during security inspection, a lock equipped with two locking units has been developed. For instance, Travel Sentry™ Co. of U.S.A. introduced a number of locks for this purpose. They mainly have one locking unit to allow luggage owners to lock and unlock during use, and another locking unit for security inspection. Hence the security inspection people can perform routine security inspection through a normal unlocking procedure to open the lock, and close the lock after the security inspection is finished. Therefore damage of the lock may be prevented, and the luggage has proper protection after security inspection.

However, the lock mentioned above still has a drawback, namely that after the security inspection was done and the lock is relocked again, there is no indication to warn the luggage owners that the lock has been unlocked.

SUMMARY OF THE INVENTION

In view of the problem, the primary object of the invention is to provide a lock that combines two locking units that function independently so that the luggage owners can recognize if either of the locking unit has been unlocked.

In order to achieve the foregoing object, the invention provides a padlock with a status indicator that has a window on the surface of its body and an indicator in the lock underneath and corresponding to the window position. The indicator is switched to different indication positions corresponding to the window once different locking units have been unlocked so that luggage owners can see the indication position through the window and recognize the locking unit that has been unlocked.

The foregoing, as well as additional objects, features and advantages of the invention will be more readily apparent from the following detailed description, which proceeds with reference to the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
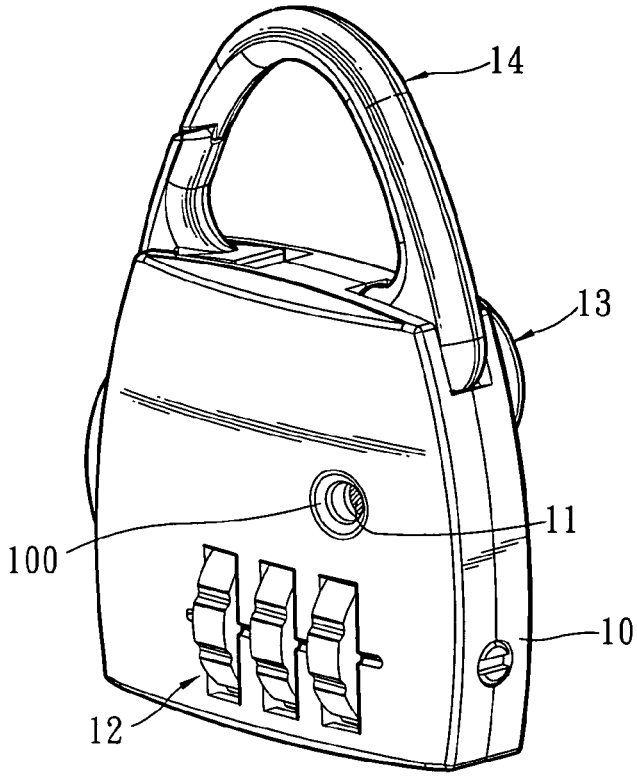
FIG. 1 is a perspective view of the lock according to the invention.
Figure 2:
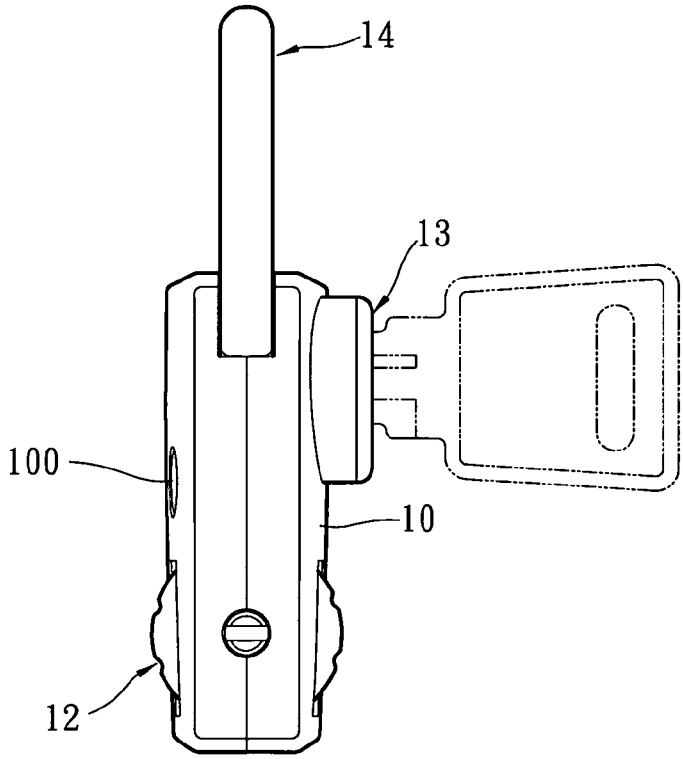
FIG. 2 is a side view of the lock according to the invention.

Refer to FIGS. 1 and 2 for the perspective and side views of an embodiment of the invention. The lock according to the invention includes a body 10, which contains two locking units 12 and 13 and a shackle 14 that is coupled on the body 10 externally, may be locked by the locking units 12 and 13, and forms a closed space 15 jointly with the body 10. The two locking units 12 and 13 are referred to as the first locking unit 12 and the second locking unit 13 hereinafter. In the following embodiments, the two locking units 12 and 13 adopt combination lock and key lock structures. However, in practice, this is not a limitation, since other types of locks may also be used.

Figure 3A:
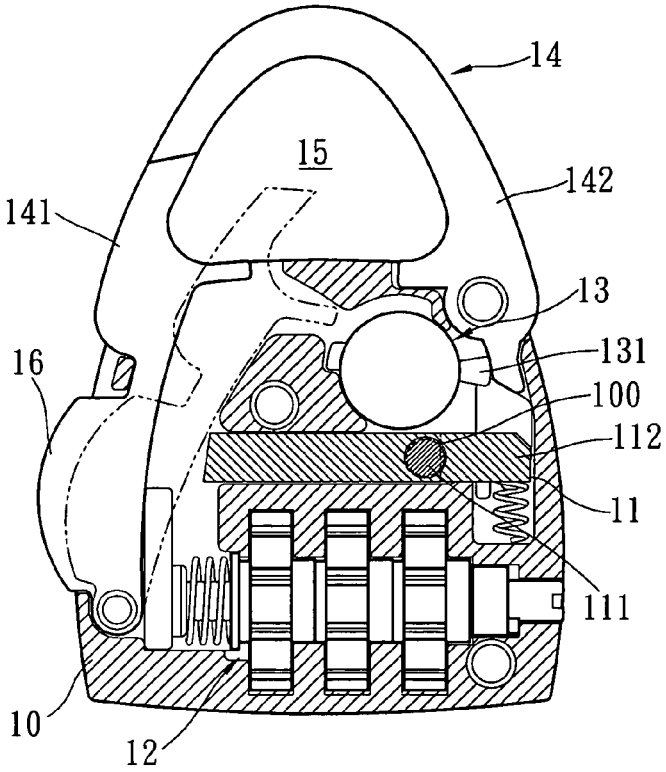
FIGS. 3A and 3B are schematic views of the structure of the lock of the invention.
Figure 3B:
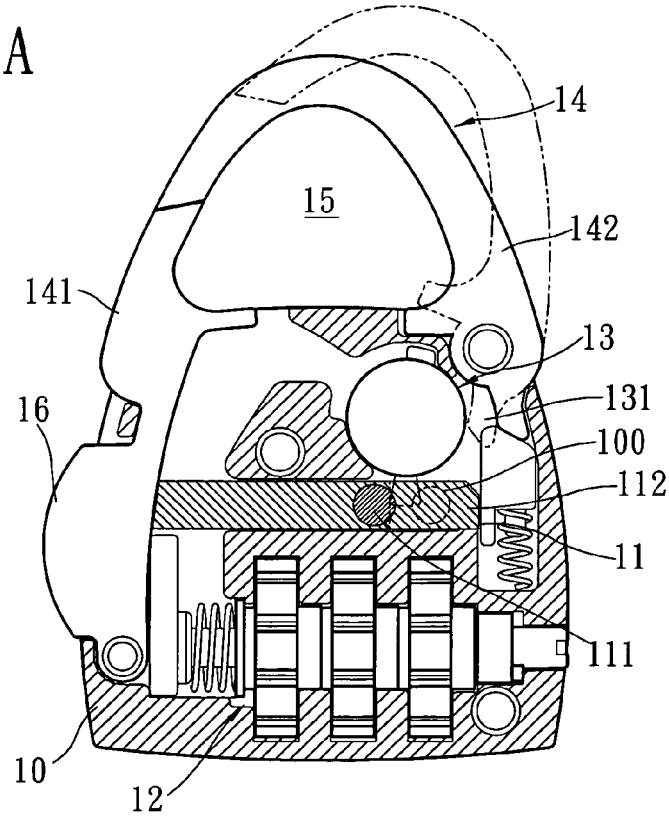

Refer to FIGS. 3A and 3B for the structure of an embodiment of the invention. The body 10, besides containing the first locking unit 12 and the second locking unit 13, also houses an indicator 11. The indicator 11 has recognition marks 111 and 112 that may be switched to a "first indication position" as shown in FIG. 3A, and a "second indication position" as shown in FIG. 3B, and may be seen through a window 100 (indicated by broken lines in the drawings) formed on the surface of the body 10 to recognize the position of the indicator 11.

Hence when the indicator 11 is moved to different indication positions, the recognition marks 111 and 112 formed thereon also are moved to the corresponding window 100 to be recognized. The recognition marks 111 and 112 may be, but are not limit to, graphics, characters, color patches and combinations thereof, and may be formed on the indicator 11 by, but not limit to, printing, carving, painting, sticking paper, and the like.

In practice, the shackle 14 consists of two latch arms 141 and 142. One latch arm 141 is lockable by the first locking unit 12, while the other latch arm 142 is lockable by the second locking unit 13. By means of such a construction, when the first locking unit 12 is actuated and changed from a locking condition to an unlocking condition, the latch arm 141 is moved by a linking or indirectly driving pushbutton 16 to form a gap in the closed space 15 formed with the body 10. Consequently, the indicator 11 is moved to the first indication position. When the pushbutton 16 and the latch arm 141 are moved back to the position before the force is applied, the indicator 11 is not moved back.

In such a condition, only when the second locking unit 13 is moved from the original locking position to the unlocking position can the latch arm 142 be moved to generate the gap in the closed space 15. The second locking unit 13 has an actuation strut 131 that moves the indicator 11 to the second indication position at the same time while being switched to the unlocking position. As the second locking unit 13 can move the indicator 11 in only one way direction as the first locking unit 12, when it returns to the locking position the indicator 11 remains in the second indication position.

Therefore, through the unlocking operations of the two different locking units 12 and 13, the indicator 11 is also switched to different indication positions that can be seen through the corresponding window 100. Hence the luggage owner can tell which of the locking units 12 and 13 has been unlocked.

In this embodiment, the other latch arm 142 may be coupled with the second locking unit 13 and moved therein synchronously. In addition, the switching movement of the indicator 11 is not limited to sliding as shown in the drawings. For instance, the indicator 11 may also be switched by swiveling, which may be seen as another embodiment of the invention.

Figure 4:
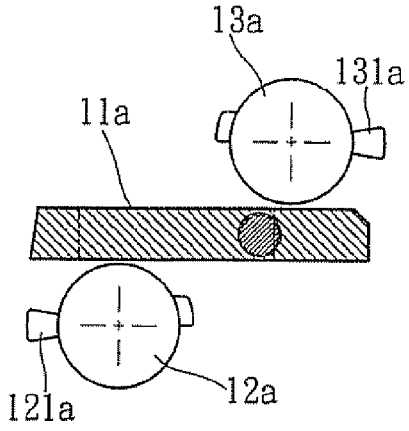
FIG. 4 is a schematic view of another embodiment of the lock equipped with two locking units according to the invention.

Refer to FIG. 4 for another embodiment of the invention. It differs from the previous embodiments by having a key (not shown in the drawing) to drive a rotary core to execute locking and unlocking operations of the first locking unit 12*a* and the second locking unit 13*a*. That is, the two locking units 12*a* and 13*a* are key locks. They have respectively actuation struts 121*a* and 131*a* to move the indicator 11*a* to the different indication positions while the locking units 12*a* and 13*a* are switched from the locking position to the unlocking position.

Figure 5:
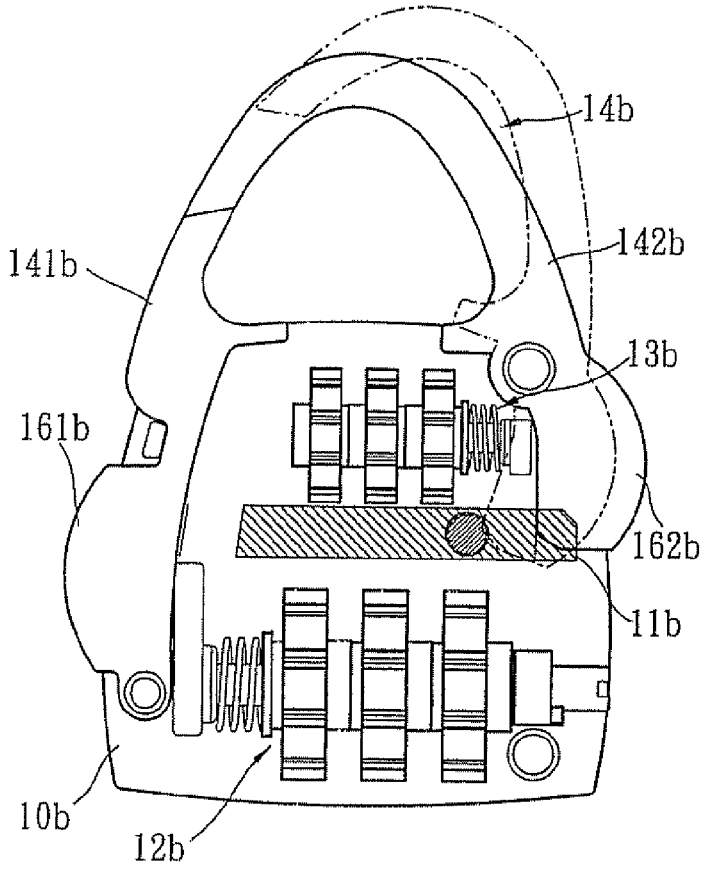
FIG. 5 is a schematic view of yet another embodiment of the lock equipped with two locking units according to the invention.

Refer to FIG. 5 for still another embodiment of the invention. It is an alteration of the two locking units based on the previous embodiments. The first locking unit 12*b* and the second locking unit 13*b* of the body 10*b* are combination locks, and may be actuated and switched respectively to an unlocking condition and a locking condition. The body 10*b* further has a first pushbutton 161*b* and a second pushbutton 162*b*. The first pushbutton 161*b* is lockable by the first locking unit 12*b*. While the first locking unit 12*b* is in the unlocking condition, the indicator 11*b* is moved to the first indication position. The second pushbutton 162*b* is lockable by the second locking unit 13*b*. While the second locking unit 13*b* is in the unlocking condition, the indicator 11*b* is moved to the second indication position The shackle 14*b* consists of a first latch arm 141*b* and a second latch arm 142*b*. In practice, the first latch arm 141*b* and the second latch arm 142*b* may be coupled respectively with the first pushed button 161*b* and second pushbutton 162*b*, and are lockable by the first locking unit 12*b* and the second locking unit 13*b* at the same time.

By means of the constructions set forth above, the indicator, which is in the lock underneath and corresponding to the window location, is switched to different indication positions when different locking units have finished locking and unlocking operations. Hence luggage owners can recognize through the window on the lock which locking unit has been unlocked.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A padlock with a status indicator, comprising:

a body;

an indicator located in the body having recognition marks that are switchable to a first indication position and a second indication position;

a first locking unit located on the body operable and switchable between an unlocking condition and a locking condition;

a pushbutton lockable by the first locking unit to move the indicator to the first indication position when the first locking unit is in the unlocking condition;

a second locking unit located on the body to be actuated independently and switched to a unlocking position and a locking position, and to move the indicator in a one way direction to the second indication position during moving between the unlocking position and the locking position; and a shackle lockable by the first locking unit or the second locking unit to form a closed space with the body, and being movable relative to the body when the locking condition or the locking position of the first locking unit or the second locking unit respectively is released, to form a gap in the closed space.

2. The padlock with a status indicator of claim 1, wherein the second locking unit has an actuation strut to move the indicator.

3. The padlock with a status indicator of claim 1, wherein the shackle includes two latch arms, one latch arm lockable by the first locking unit, the other latch arm lockable by the second locking unit.

4. The padlock with a status indicator of claim 3, wherein the latch arm lockable by the first locking unit is coupled with the pushbutton and moved therewith synchronously.

5. The padlock with a status indicator of claim 3, wherein the second locking unit is capable of being coupled with the other latch arm lockable by the second locking unit, and capable of being moved therewith synchronously.

6. The padlock with a status indicator of claim 1, wherein the recognition marks are graphics.

7. The padlock with a status indicator of claim 1, wherein the recognition marks are characters.

8. The padlock with a status indicator of claim 1, wherein the recognition marks are color patches.

9. The padlock with a status indicator of claim 1, wherein the body has a window on a surface for seeing through the interior thereof, and the recognition marks corresponds to the window.

10. A padlock with a status indicator, comprising:

a body which has a window on a surface for seeing through the interior thereof;

an indicator located in the body having recognition marks corresponding to the window that are switchable to a first indication position and a second indication position;

a first locking unit and a second locking unit that are located on the body and operable and switchable between different unlocking conditions and different locking conditions;

a first pushbutton lockable by the first locking unit and moving the indicator to the first indication position when the first locking unit is in the unlocking condition;

a second pushbutton lockable by the second locking unit and moving the indicator in a one way direction to the second indication position when the second locking unit is in the unlocking condition; and a shackle lockable by at least one of the first locking unit and the second locking unit to form a closed space with the body, and being movable relative to the body when one of the locking conditions of the first locking unit or the second locking unit respectively is released to form a gap in the closed space.

11. The padlock with a status indicator of claim 10, wherein the shackle includes a first latch arm and a second latch arm, the first latch arm lockable by the first locking unit, the second latch arm lockable by the second locking unit.

12. The padlock with a status indicator of claim 11, wherein the first latch arm is coupled with the first pushbutton and moved synchronously therewith.

13. The padlock with a status indicator of claim 11, wherein the second latch arm is coupled with the second pushbutton and moved synchronously therewith.

14. The padlock with a status indicator of claim 10, wherein the recognition marks are graphics.

15. The padlock with a status indicator of claim 10, wherein the recognition marks are characters.

16. The padlock with a status indicator of claim 10, wherein the recognition marks are color patches.

* * * * *